US010962016B2

(12) United States Patent
Brasz et al.

(10) Patent No.: US 10,962,016 B2
(45) Date of Patent: Mar. 30, 2021

(54) ACTIVE SURGE CONTROL IN CENTRIFUGAL COMPRESSORS USING MICROJET INJECTION

(71) Applicants: Danfoss A/S, Nordborg (DK); THE FLORIDA STATE UNIVERSITY RESEARCH FOUNDATION, INCORPORATED, Tallahassee, FL (US)

(72) Inventors: Joost Brasz, Nordborg (DK); William Bilbow, Tallahassee, FL (US); Farrukh Alvi, Tallahassee, FL (US); Erik Fernandez, Oviedo, FL (US); Jennifer Gavin, Windermere, FL (US)

(73) Assignee: DANFOSS A/S

( * ) Notice: Subject to any disclaimer, the term of this patent is extended or adjusted under 35 U.S.C. 154(b) by 102 days.

(21) Appl. No.: 16/075,168

(22) PCT Filed: Feb. 4, 2016

(86) PCT No.: PCT/US2016/016529
§ 371 (c)(1),
(2) Date: Aug. 3, 2018

(87) PCT Pub. No.: WO2017/135949
PCT Pub. Date: Aug. 10, 2017

(65) Prior Publication Data

US 2019/0040865 A1 Feb. 7, 2019

(51) Int. Cl.
*F04D 17/12* (2006.01)
*F04D 27/02* (2006.01)
(Continued)

(52) U.S. Cl.
CPC ..... *F04D 17/122* (2013.01); *F04D 27/0215* (2013.01); *F04D 27/0238* (2013.01);
(Continued)

(58) Field of Classification Search
CPC ..... F04D 29/684; F04D 27/0238; F04D 27/0215; F04D 27/009; F04D 27/02; F04D 27/0207; F04D 27/0223; F04D 15/0011
See application file for complete search history.

(56) References Cited

U.S. PATENT DOCUMENTS 3,070,974 A 1/1963 Greenwald
3,391,858 A 7/1968 De Lancey
(Continued)

FOREIGN PATENT DOCUMENTS

CN 103154525 A 6/2013
CN 103174678 A 6/2013
(Continued)

OTHER PUBLICATIONS

Kumar, Vikas, et al. "Active Control of Flow Separation Using Supersonic Microjets," Proceedings of FEDSM'03, 4th ASME_JSME Joint Fluids Engineering Conference, Honolulu HI, USA, Jul. 6-11, 2003. Copyright 2003 by ASME.
(Continued)

*Primary Examiner* — Nathaniel E Wiehe
*Assistant Examiner* — Danielle M. Christensen
(74) *Attorney, Agent, or Firm* — Carlson, Gaskey & Olds, P.C.

(57) ABSTRACT

A centrifugal compressor according to an exemplary aspect of the present disclosure includes, among other things, an impeller provided in a main flow path and configured to pressurize a main flow of fluid. The compressor also includes a secondary flow path configured to provide a secondary flow by recirculating a portion of the main flow. The amount of the main flow that becomes the secondary flow is less than or equal to 15%. A method is also disclosed.

16 Claims, 5 Drawing Sheets

(51) Int. Cl.

| | |
|---|---|
| ***F04D 29/44*** | (2006.01) |
| ***F04D 29/68*** | (2006.01) |
| *F04D 27/00* | (2006.01) |
| *F04D 29/46* | (2006.01) |

(52) U.S. Cl.
CPC ..... *F04D 29/444* (2013.01); *F04D 29/684* (2013.01); *F04D 27/009* (2013.01); *F04D 27/0246* (2013.01); *F04D 29/462* (2013.01); *F05D 2250/52* (2013.01)

(56) References Cited

U.S. PATENT DOCUMENTS

| | | | | |
|---|---|---|---|---|
| 3,741,676 | A | 6/1973 | Silvern et al. | |
| 3,901,620 | A | 8/1975 | Boyce | |
| 3,976,390 | A | 8/1976 | Silvern et al. | |
| 4,094,613 | A | 6/1978 | Bracken | |
| 4,255,080 | A | 3/1981 | Wilson et al. | |
| 4,378,194 | A | 3/1983 | Bandukwalla | |
| 4,503,684 | A | 3/1985 | Mount et al. | |
| 4,695,224 | A | 9/1987 | Lown | |
| 4,938,661 | A | 7/1990 | Kobayashi et al. | |
| 5,669,756 | A | 9/1997 | Brasz et al. | |
| 5,709,526 | A | 1/1998 | McLeister et al. | |
| 6,036,432 | A | 3/2000 | Sishtla et al. | |
| 6,155,802 | A | 12/2000 | Choi et al. | |
| 6,672,826 | B2 | 1/2004 | LeDuc | |
| 7,326,027 | B1 | 2/2008 | Skoch et al. | |
| 7,556,473 | B2 | 7/2009 | Takeshita et al. | |
| 7,775,759 | B2 * | 8/2010 | Sirakov | F04D 29/4213 415/1 |
| 7,871,239 | B2 | 1/2011 | Sorokes | |
| 8,021,104 | B2 | 9/2011 | Gu et al. | |
| 8,122,724 | B2 | 2/2012 | Slovisky et al. | |
| 8,156,757 | B2 | 4/2012 | Doty et al. | |
| 8,210,793 | B2 | 7/2012 | Hale | |
| 8,272,832 | B2 | 9/2012 | Yin | |
| 8,287,232 | B2 | 10/2012 | Gu et al. | |
| 8,303,024 | B2 | 11/2012 | Alvi | |
| 8,532,830 | B2 | 9/2013 | Van Dijk | |
| 8,567,184 | B2 | 10/2013 | Scotti Del Greco et al. | |
| 8,567,207 | B2 | 10/2013 | Sommer et al. | |
| 8,894,019 | B2 | 11/2014 | Alvi | |
| 9,157,446 | B2 * | 10/2015 | Brasz | F25B 1/10 |
| 9,382,911 | B2 * | 7/2016 | Sun | F04D 27/0238 |
| 10,184,481 | B2 | 1/2019 | Brasz et al. | |
| 2002/0014088 | A1 | 2/2002 | Seki et al. | |
| 2005/0076656 | A1 | 4/2005 | Bodell, II et al. | |
| 2005/0223737 | A1 | 10/2005 | Conry | |
| 2006/0045772 | A1 | 3/2006 | Slovisky et al. | |
| 2007/0144170 | A1 | 6/2007 | Griffith | |
| 2007/0154304 | A1 | 6/2007 | Abdallah | |
| 2007/0217902 | A1 * | 9/2007 | Sirakov | F04D 29/4213 415/58.4 |
| 2008/0232952 | A1 | 9/2008 | Gu et al. | |
| 2009/0087321 | A1 | 4/2009 | Morozumi et al. | |
| 2009/0213686 | A1 | 8/2009 | Heikkilae et al. | |
| 2010/0129205 | A1 | 5/2010 | Schwerdel | |
| 2010/0143111 | A1 | 6/2010 | Kuehnel | |
| 2011/0214421 | A1 | 9/2011 | Schmitt et al. | |
| 2011/0277498 | A1 | 11/2011 | Kaart | |
| 2012/0048387 | A1 | 3/2012 | Galeotti | |
| 2013/0036760 | A1 * | 2/2013 | Sun | F04D 29/681 62/467 |
| 2013/0152582 | A1 | 6/2013 | Anschel et al. | |
| 2013/0209222 | A1 | 8/2013 | Schofield | |
| 2013/0220289 | A1 | 8/2013 | Maceroni et al. | |
| 2013/0236300 | A1 | 9/2013 | Hiller et al. | |
| 2014/0208788 | A1 | 7/2014 | Brasz et al. | |

FOREIGN PATENT DOCUMENTS

| | | | |
|---|---|---|---|
| CN | 105051372 | A | 11/2015 |
| DE | 842893 | C | 7/1952 |
| DE | 102005046144 | A1 | 6/2006 |
| DE | 102008007027 | A1 | 8/2009 |
| DE | 103013201482 | B3 | 10/2013 |
| EP | 0871853 | A1 | 10/1998 |
| EP | 1321679 | B1 | 6/2004 |
| EP | 1557568 | A2 | 7/2005 |
| EP | 1654462 | A1 | 5/2006 |
| EP | 1704330 | A1 | 9/2006 |
| EP | 1651847 | B1 | 11/2006 |
| EP | 1753961 | A1 | 2/2007 |
| EP | 0898083 | B2 | 4/2008 |
| EP | 1942259 | A2 | 7/2008 |
| EP | 1640673 | B1 | 8/2008 |
| EP | 2080908 | A2 | 7/2009 |
| EP | 1783048 | B1 | 6/2011 |
| EP | 2377759 | A1 | 10/2011 |
| EP | 2385230 | A2 | 11/2011 |
| EP | 2423515 | A1 | 2/2012 |
| EP | 2447541 | A1 | 5/2012 |
| EP | 2615308 | A1 | 7/2013 |
| FR | 2920829 | A1 | 3/2009 |
| GB | 2268228 | A | 1/1994 |
| GB | 2305974 | A | 4/1997 |
| SU | 682674 | A1 | 8/1979 |
| WO | 2013128093 | A1 | 9/2013 |
| WO | 2013139568 | A1 | 9/2013 |

OTHER PUBLICATIONS

Kumar, Vikas, et al. "Efficient Control of Separation Using Microjets," American Institute of Aeronautics and Astronautics, Dept. of Mechanical Engineering, Florida A & M University and Florida State University. Jun. 2005.

Kumar, Vikas, et al. "Toward Understanding and Optimizing Separation Control Using Microjets," Florida A & M University and Florida State University. AAIA Journal 47(11): 2544-2557. Nov. 2009.

International Search Report and Written Opinion for International Application No. PCT/US2016/016529 completed Mar. 28, 2016.

International Preliminary Report on Patentability for International Application No. PCT/US2016/016529 dated Aug. 16, 2018.

Supplementary European Search Report for European Application No. 16889598.5, completed on Aug. 2, 2019.

* cited by examiner

ACTIVE SURGE CONTROL IN CENTRIFUGAL COMPRESSORS USING MICROJET INJECTION

BACKGROUND

This disclosure relates to centrifugal compressors for fluids such as air or refrigerant, as examples.

Compressors are used to pressurize a fluid for use in a larger system, such as a refrigerant loop, air cycle machine, or a turbocharger, to name a few examples. Centrifugal compressors are known to include an inlet, an impeller, a diffuser, and an outlet. In general, as the impeller rotates, fluid is drawn from the inlet to the impeller where it is pressurized and directed radially outward through a diffuser, and downstream to another compression stage or an outlet.

Some known centrifugal compressors have used variable inlet guide vanes, disposed in the inlet, to regulate capacity during part-load operating conditions. Other known compressors have employed a variable-geometry diffuser downstream from an impeller to improve capacity control during such part-load operating conditions. Further still, some prior compressors, such those described in U.S. Pat. No. 5,669,756 to Brasz and U.S. Pat. No. 9,157,446 to Brasz, have suggested recirculating fluid to improve capacity control.

SUMMARY

This disclosure relates to a centrifugal compressor having flow augmentation. In particular, in one example, a portion of the fluid flowing in a main flow path of the compressor is recirculated back into the main flow path to improve capacity control. In another example, the fluid is provided from an external source.

A centrifugal compressor according to an exemplary aspect of the present disclosure includes, among other things, an impeller provided in a main flow path and configured to accelerate a main flow of fluid. The compressor also includes a secondary flow path configured to provide a secondary flow by recirculating a portion of the main flow. Further, less than or equal to 15% of the main flow becomes the secondary flow.

A centrifugal compressor according to another exemplary aspect of the present disclosure includes, among other things, an impeller provided in a main flow path and configured to pressurize a main flow of fluid, a secondary flow path configured to provide a secondary flow by recirculating a portion of the main flow, and injection nozzles. The injection nozzles are configured to introduce the secondary flow back into the main flow path, and each have a diameter within a range of 300 to 500 microns. Further, the injection nozzles are radially aligned and circumferentially spaced-apart from one another by an arc length within a range of 8 and 25 of the diameters.

A method of operating a centrifugal compressor according to an exemplary aspect of the present disclosure includes, among other things, establishing a main flow of fluid along a main flow path, pressurizing the main flow with an impeller, and selectively providing a secondary flow by recirculating less than or equal to 15% of the main flow.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
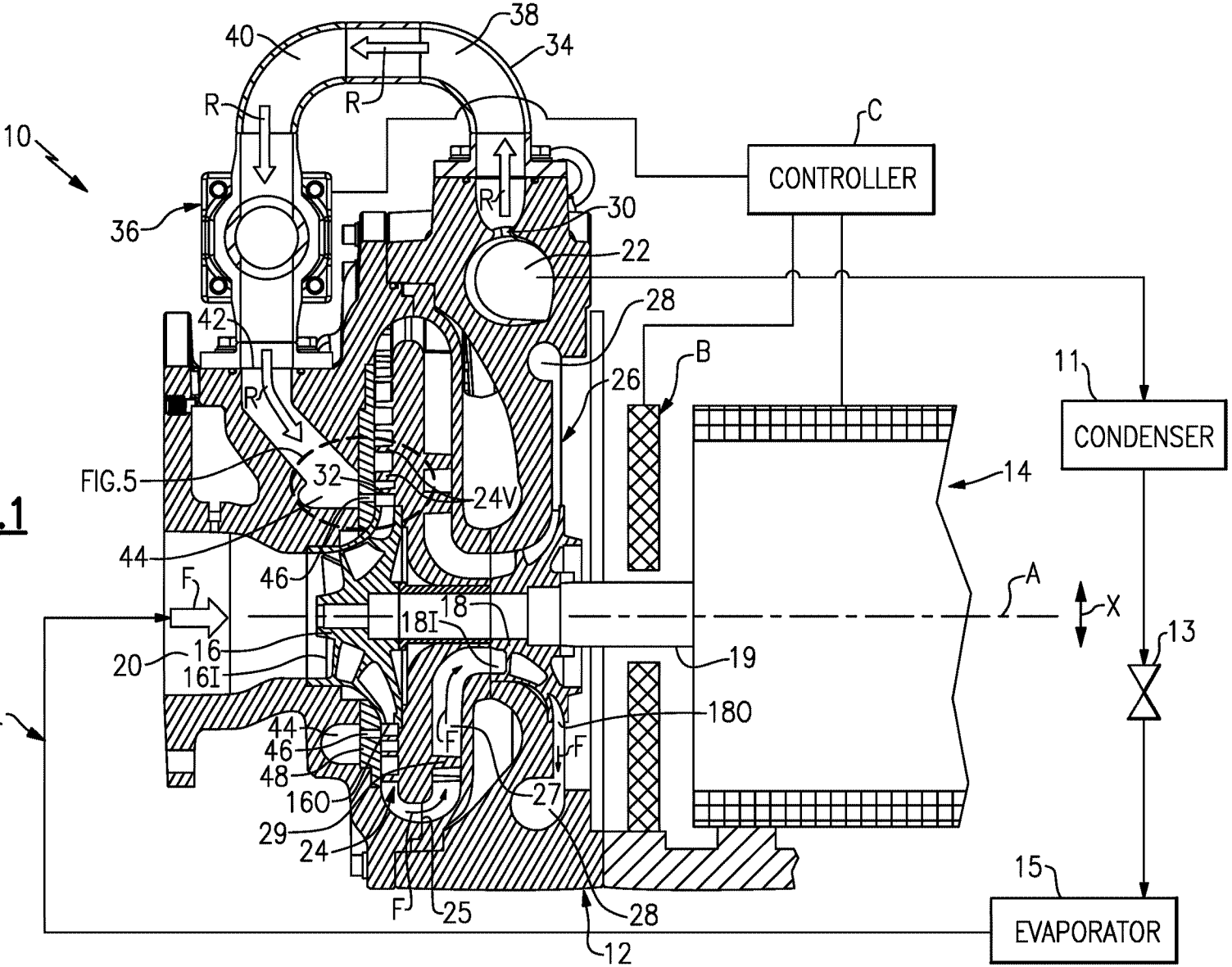
FIG. 1 is a highly schematic view of a compressor.

FIG. 1 illustrates a compressor 10 ("compressor 10") for pressurizing a flow of fluid and circulating that fluid for use within a system. Example fluids include air and refrigerants, including chemical refrigerants such as R-134a and the like. The compressor 10 shown in FIG. 1 is a refrigerant compressor. As mentioned, however, this disclosure is not limited to use with refrigerant, and extends to other fluids, such as air. In one example, the compressor 10 is in fluid communication with a refrigeration loop L. Refrigeration loops L are known to include a condenser 11, an expansion device 13, and an evaporator 15. This disclosure is not limited to compressors that are used with refrigeration loops, and extends to other systems such as gas turbines, air cycle machines, turbochargers, etc.

Turning to the example of FIG. 1, the compressor 10 includes a housing 12, which encloses an electric motor 14. The housing 12 may comprise one or more pieces. The electric motor 14 rotationally drives at least one impeller about an axis A to compress fluid. The motor 14 may be driven by a variable frequency drive. The compressor 10 includes a first impeller 16 and a second impeller 18, each of which is connected to the motor 14 via a shaft 19. While two impellers are illustrated, this disclosure extends to compressors having one or more impellers. The shaft 19 is supported by a bearing assembly B, which in this example is a magnetic bearing assembly.

The housing 12 establishes a main flow path F. In particular, the housing 12 establishes an outer boundary for the main flow path F. A first, or main, flow of fluid (sometimes referred to herein as a "main flow") is configured to flow along the main flow path F between a compressor inlet 20 and a compressor outlet 22. In this example, there are no inlet guide vanes disposed at the compressor inlet 20. The lack of inlet guide vanes reduces the number of mechanical parts in the compressor 10, which would require maintenance and/or replacement after prolonged use. As will be appreciated from the description below, the presence of the first vaned diffuser 24 allows for the elimination of inlet guide vanes. Despite this, the present disclosure extends to compressors that have a vaneless diffuser. This disclosure also extends to compressors with inlet guide vanes.

From left to right in FIG. 1, the main flow path F begins at the compressor inlet 20, where fluid is drawn toward the first impeller 16. The first impeller 16 is provided in the main flow path F. and is arranged upstream of the second impeller 18 relative to the main flow path F. The first impeller 16 includes an inlet 16I arranged axially, generally parallel to the axis A, and an outlet 160 arranged radially, in the radial direction X which is normal to the axis A.

Immediately downstream of the outlet 160, in this example, is a first vaned diffuser 24. The first vaned diffuser 24 includes a plurality of vanes 24V. In this example, the vanes 24V are stationary vanes. That is, the relative orientation of vanes 24V is not adjustable during operation of the compressor 10, and the flow path created between the vanes 24V is not adjustable during operation of the compressor 10. While this disclosure is not limited to stationary vaned diffusers, using a diffuser with stationary vanes has the advantage of reducing the number of mechanical parts in the compressor 10 (which, again, would need to be serviced and/or replaced after a period of use). Further, avoiding a variable geometry diffuser may have the benefit of eliminating leakage flow that is commonly associated with variable geometry diffusers. Again, as mentioned above, while a vaned diffuser is illustrated, this disclosure extends to compressors with vaneless diffusers.

The main flow path F extends away from the axis A and through the diffuser 24 in the radial direction X. Next, the main flow path F turns 180 degrees in a cross-over bend 25, and flows radially inward through a return channel 27 having deswirl vanes 29 toward the second impeller 18. Like the first impeller 16, the second impeller 18 includes an axially oriented inlet 18I and a radially oriented outlet 18O. A second stage diffuser 26 is arranged downstream of the second impeller 18. In this example, the second stage diffuser 26 includes stationary vanes. The second stage diffuser need not include vanes, however. An outlet volute 28 is provided downstream of the second stage diffuser 26. The outlet volute 28 generally spirals about the axis A and leads to the compressor outlet 22.

The compressor 10, in this example, includes a secondary flow path R configured to recirculate a portion of the fluid (i.e., a "secondary flow" of fluid) from the main flow path F between a first location 30 and a second location 32 upstream of the first location 30. Again, in other examples, the secondary flow path R is provided from an external source of fluid, and is not provided by recirculating fluid from the main flow path F.

Continuing with the FIG. 1 example, the first location 30 is adjacent the compressor outlet 22, and the second location 32 is located downstream of the first impeller 16, as will be discussed below. The first and second locations 30, 32 may be provided at other locations, however, without departing from the scope of this disclosure. Alternative candidates for the first location 30 are the cross-over bend 25, or a location within the return channel 27. The second location 32 may alternatively be provided at the inlet of the second stage diffuser 26.

The secondary flow path R is provided, in part, by a recirculation line 34. In this example, the recirculation line 34 extracts secondary flow from outlet volute 28, at which point the flow of fluid is swirl-free. This in contrast to extracting the flow circumferentially at the exit of the diffuser, in which case multiple passages separated by deswirl vanes are needed to maintain the pressure required for injection of the flow through the injection nozzles 46. Without deswirl vanes, conservation of angular momentum causes an increase in velocity and a decrease in pressure due to the radius of the injection nozzles 46. This reduction in static pressure limits the secondary flow R as a result of the reduced pressure differential over the injection nozzles 46.

The secondary flow path R further includes a flow regulator 36. In this example, the flow regulator 36 is provided external to the housing 12, in the recirculation line 34. This allows for ease of replacement and installation of the flow regulator 36. The flow regulator 36 may be any type of device configured to regulate a flow of fluid, including mechanical valves, such as butterfly, gate or ball valves with electrical or pneumatic control (e.g., valves regulated by existing pressures). The flow regulator 36 may include an actuator operable to position a valve in response to instructions from a controller C. The controller C may be any known type of controller including memory, hardware, and software. The controller C is configured to store instructions, and to provide those instructions to the various components of the compressor 10 (including the motor 14, and other structures, such as magnetic bearing assembly B). The controller C may further include one or more components.

The secondary flow path R initially extends radially outward, in a direction generally normal to the axis A, from the first location 30 along the main flow path F to a first bend 38 in the recirculation line 34. The secondary flow path R then extends axially, from right to left in FIG. 1 (and generally parallel to the axis A), from the first bend 38 to a second bend 40, where the secondary flow path R then turns radially inward toward the axis A. In this example, the flow regulator 36 is provided in the secondary flow path R downstream of the second bend 40. While the secondary flow path R is illustrated in a particular manner, the secondary flow path R may be arranged differently.

Downstream of the flow regulator 36, the secondary flow path R enters the housing 12 at an entrance 42 to a recirculation volute 44. The velocity (kinetic energy) of the secondary flow is substantially maintained entering the recirculation volute 44 while it is reduced when entering a plenum. As a result, the recirculation volute 44 results in a more effective flow recirculation system. While a volute 44 is shown, the volute could be replaced with a plenum.

The recirculation volute 44 spirals around the axis A, and is in communication with a plurality of injection nozzles 46. In this example, the injection nozzles 46 are formed in an injector plate 48. The secondary flow is introduced into the main flow path F via the injection nozzles 46, as will be discussed below.

Figure 2:
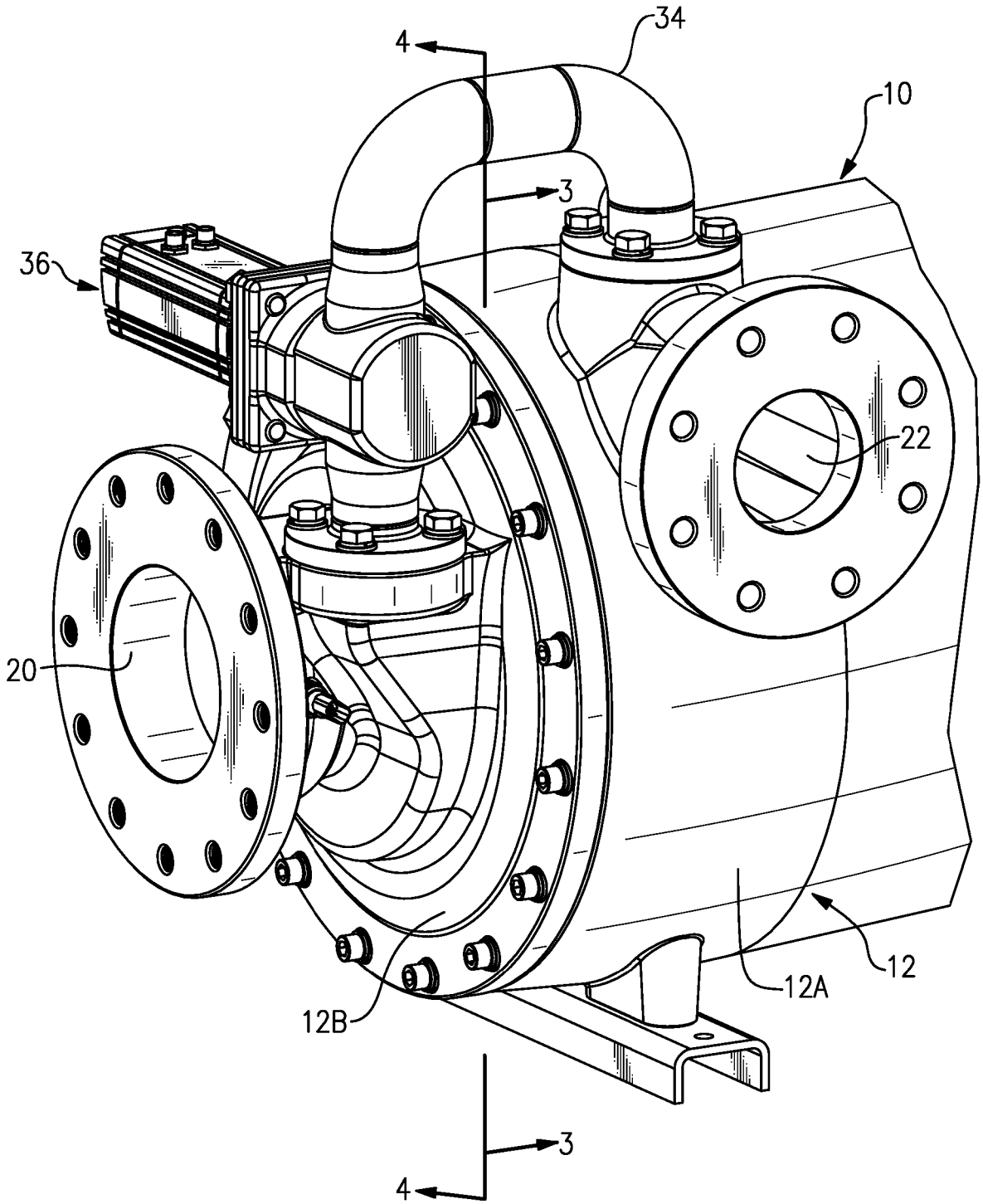
FIG. 2 is an exterior, perspective view of a portion of the compressor of FIG. 1.

FIG. 2 illustrates the portion of the compressor 10 from an exterior perspective. As illustrated, the housing 12 may include separate pieces, illustrated as first and second portions 12A, 12B. The compressor outlet 22 is established by the first portion 12A, while the compressor inlet 20 is established by the second portion 12B. The recirculation line 34 extends between the first portion of the housing 12A and the second portion of the housing 12B.

Figure 3:
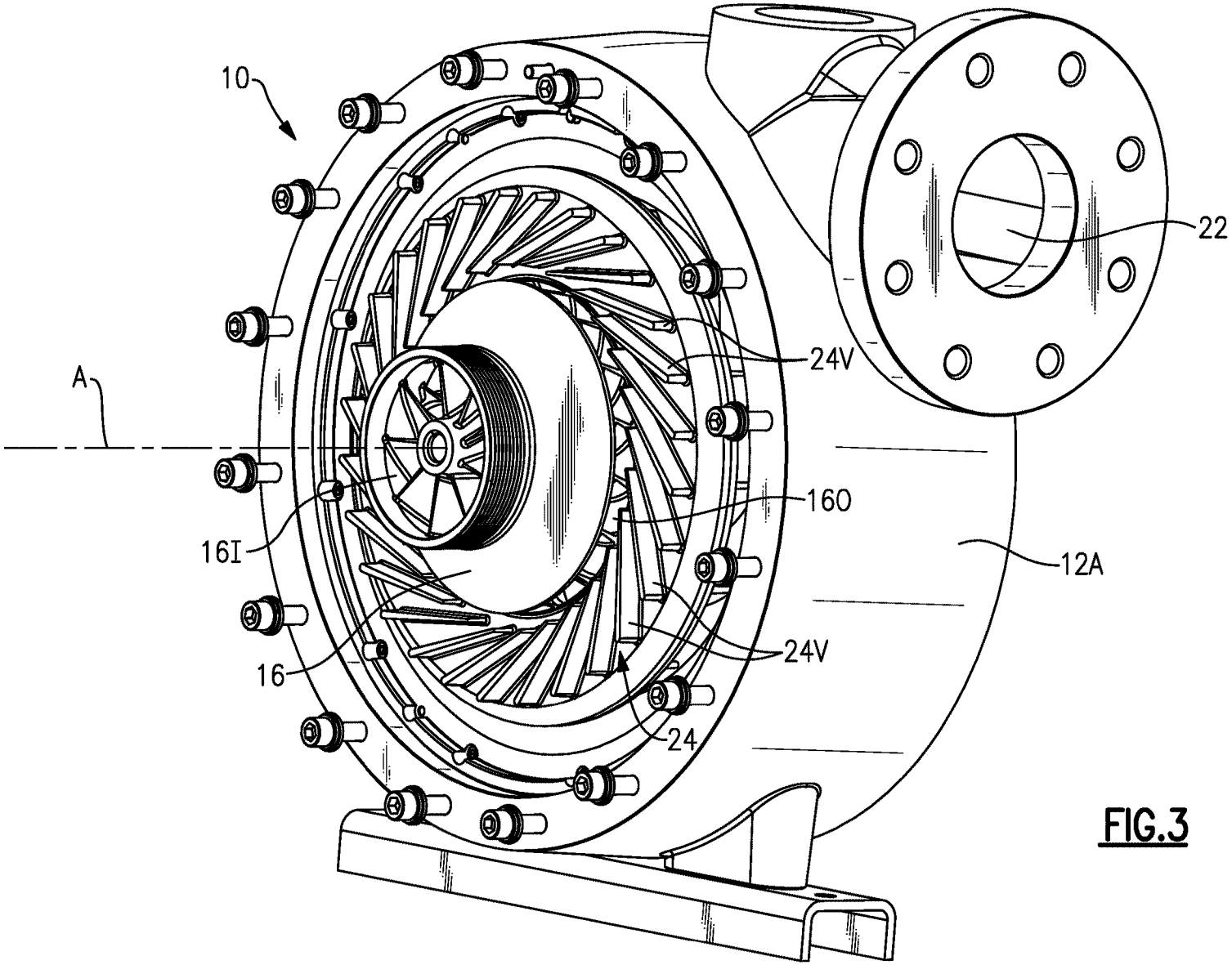
FIG. 3 is a view taken along line 3-3 from FIG. 2.

FIG. 3 is a view taken along line 3-3 in FIG. 2, and illustrates the detail of the first portion of the housing 12A with the second portion of the housing 12B removed. In particular. FIG. 3 illustrates the arrangement of the first impeller 16 relative to the first vaned diffuser 24. As illustrated, the vanes 24V are positioned adjacent one another, and a plurality of throats T (FIG. 6) are established between adjacent vanes 24V. As fluid is expelled radially outward with a large tangential velocity component from the first impeller 16, that fluid passes through the throats T.

Figure 4A:
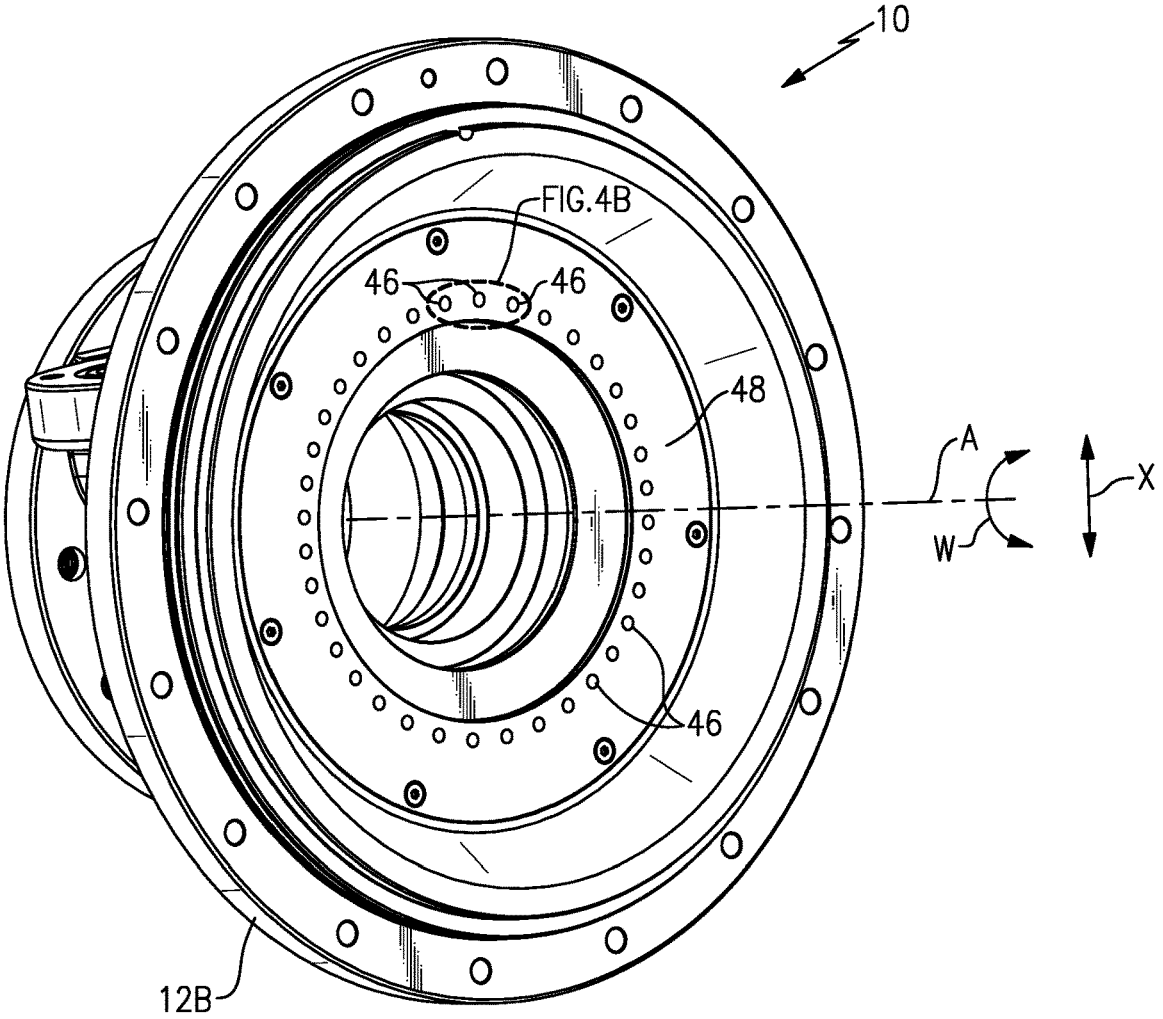
FIG. 4A is a view taken along line 4-4 from FIG. 2.

FIG. 4A is a view taken along line 4-4 in FIG. 2, and illustrates the second portion of the housing 12B with the first portion of the housing 12A removed. In particular. FIG. 4A illustrates the detail of an injector plate 48, which includes a plurality of injection nozzles 46 for flow control. The injector plate 48 may be formed integrally with the first portion of the housing 12A, or be attached separately.

As shown in FIG. 4A, the injection nozzles 46 are essentially provided in a single "ring" or array. In particular, the injection nozzles 46 are radially aligned in a radial direction X, which is normal to the axis A. The injection nozzles 46 are circumferentially spaced-apart from one another in a circumferential direction W, which is defined about the axis A. In this example, the injection nozzles 46 are evenly spaced-apart from one another in the circumferential direction W. This disclosure only employs a single "ring" of injection nozzles 46. Other examples could include additional rings, which could be employed as needed based on operating conditions.

Figure 4B:
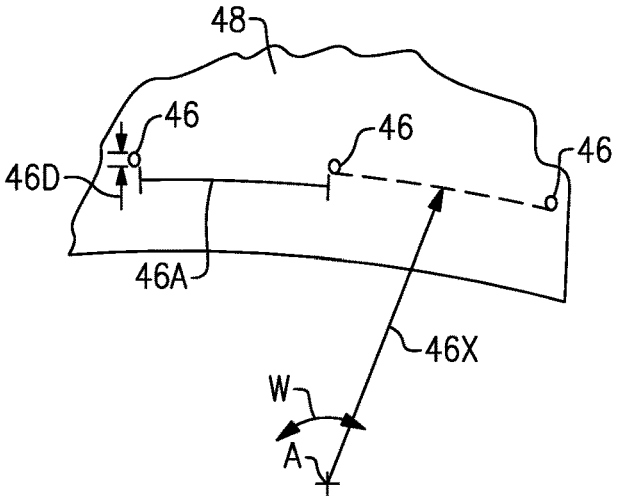
FIG. 4B is an enlarged view of the encircled area in FIG. 4A

FIG. 4B illustrates the detail of the arrangement of injection nozzles 46. In this example, the injection nozzles 46 are formed as cylindrical passageways through the injection plate 48, and each have a diameter 46D within a range of 300 to 500 microns (μm). In one particular example, the diameter 46D is substantially 300 microns. The injection nozzles 46 can be referred to as "microjets" due to their relatively small diameter. The use of such relatively small injection nozzles 46 allows one to produce very high momentum microjets while minimizing the requisite mass flow rate relative to other techniques.

As mentioned, the injection nozzles 46 are radially aligned, and are spaced apart from the axis A by a constant distance 46X. The distance 46X may be selected to correspond to a location in the diffuser 24 where fluid expelled from the impeller 16 is expected to separate, based on a mapped pressure and/or velocity distribution of the fluid in the main flow path F during various operating conditions. Further, the injection nozzles 46 are circumferentially spaced-apart from one another in the circumferential direction W by an arc length 46A within a range of 8 and 25 of the diameters 46D.

Figure 6:
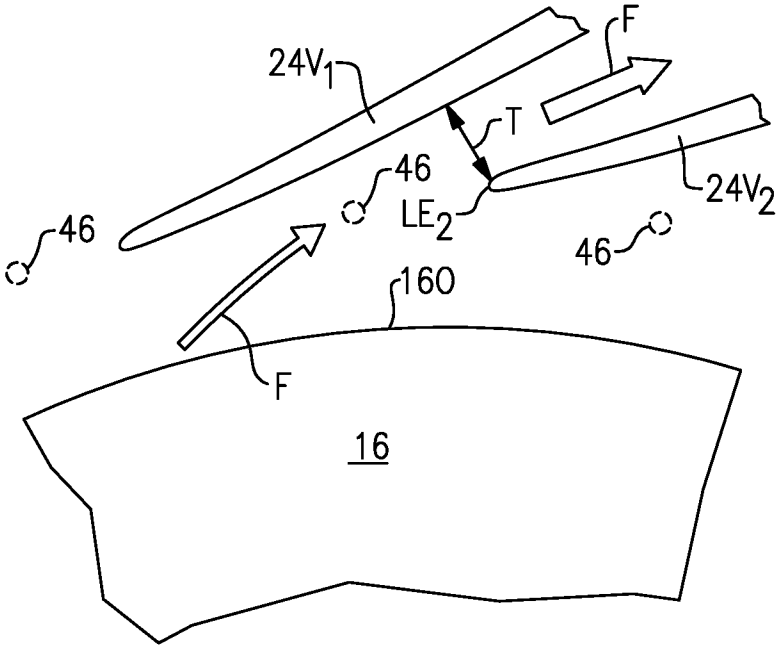
FIG. 6 illustrates an example arrangement of the injection nozzles relative to the diffuser vanes.
Figure 5:
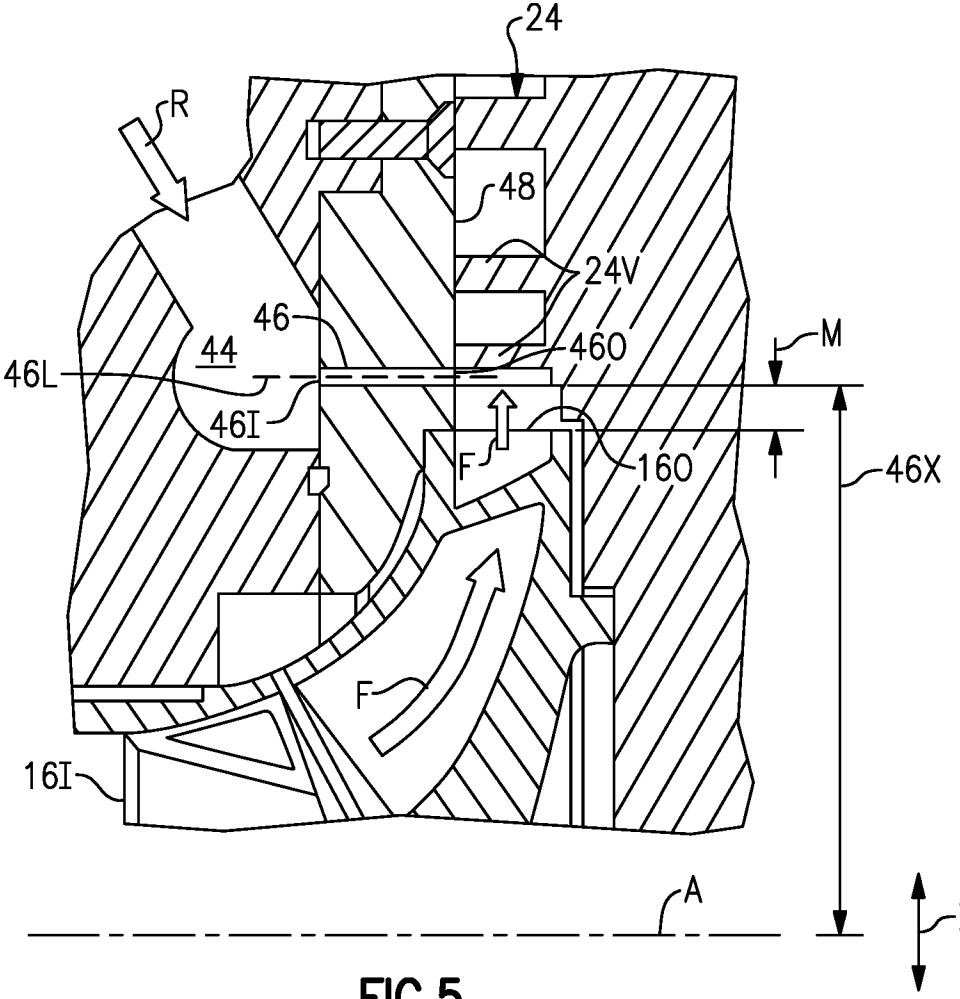
FIG. 5 is an enlarged view of the encircled area in FIG. 1.

FIGS. 5-6 illustrate the arrangement of the injection nozzles 46 relative to the first vaned diffuser 24V. Again, while a vaned diffuser is illustrated, this disclosure extends to vaneless diffusers. FIG. 5 is a close-up view showing the detail of the encircled area in FIG. 1. As illustrated in FIG. 5, the injection nozzles 46 each include an inlet 461 adjacent the recirculation volute 44, and an outlet 460 downstream of the impeller outlet 160. In this example, injection nozzles 46 are located a distance M from the impeller outlet 160, which, again, is selected to correspond to a location of expected flow separation. Further, in this example, the injection nozzles 46 have a longitudinal axis 46L arranged substantially parallel to the axis A, and substantially normal to the radial direction X. This arrangement allows the injection nozzles 46 to inject fluid from the secondary flow path R back into the main flow path F in a direction normal to the direction of the main flow.

In this example, the injection nozzles 46 are cylindrical passageways. That is, the injection nozzles 46 have a substantially constant diameter 46D along the longitudinal axis 46L. In other example, the injection nozzles 46 could be tapered and have a variable diameter along their length. Further, the injection nozzles 46 can be pitched or inclined at an angle relative to the direction of flow in the main flow path F.

FIG. 6 represents the arrangement of three injection nozzles 46 relative to two adjacent vanes 24$V_1$, 24$V_2$. In this example, the injection nozzles 46 are configured to inject fluid in a location upstream of a throat T spanning between the adjacent vanes 24$V_1$, 24$V_2$, and downstream of the impeller outlet 160.

Depending on the operating conditions of the compressor 10, the flow regulator 36 may be selectively controlled (via the controller C) to remove a portion of the fluid within the main flow path F, at the first location 30, and to inject that removed portion of fluid back into the main refrigerant flow path F via the secondary flow path R. In one example, the flow regulator 36 is controlled by the controller C in response to the operating capacity of the compressor 10. The operating capacity of the compressor 10 may be monitored by monitoring a temperature of a fluid (e.g., water) within a chiller.

In one example, the flow regulator 36 is closed when the compressor is operating at a normal capacity. A normal capacity range is about 40-100% of the designed capacity. At relatively low, part-load operating capacities (e.g., around 30% of the designed capacity), however, the controller C instructs the flow regulator 36 to open, such that fluid is injected into the main flow path F via the secondary flow path R. Additionally or alternatively, the controller may instruct the flow regulator 36 to open during compressor start-up in some examples.

The amount of the fluid within the main flow path F (i.e., the "main flow") that becomes fluid within the secondary flow path R (i.e., the "secondary flow") is less than or equal to 15% in one example. In a further example, the amount of the main flow that becomes the secondary flow is less than or equal to 10%, and in an even further example that amount is about 8.5%. The remainder of the flow is directed downstream to the outlet 22 of the compressor. These recirculation numbers are significantly reduced relative to prior systems where the amount of recirculated flow is on the order of 30%.

The injection of fluid from the secondary flow path R increases the stability of operation of the compressor 10 in part-load conditions by allowing the downstream elements (e.g., the first vaned diffuser 24, return channel 27, the second impeller 18, and the second stage diffuser 26) to experience flows closer to their optimum range. In turn, this extends the efficient operating range of the compressor 10 to lower, part-load operating conditions, which reduces the likelihood of a surge condition.

The injection nozzles 46 of this disclosure inject secondary flow back into the main flow path with significant momentum and in a location where flow separation would otherwise have occurred. The injection nozzles 46 inject fluid that interacts with the main flow and generates counter-rotating generates secondary structures, the most important of which are the large-scale counter-rotating vortex pairs. As these vortices convect in the main flow path F, they actively transfer high momentum fluid from the diffuser core flow, to lower momentum regions near the diffuser walls. This momentum transfer is the main mechanism that energizes the boundary layer flow within the diffuser. Doing so makes the main flow more resistant to flow separation, which suppresses stall. Thus, the sizing and arrangement of the injection nozzles 46 not only provides for effective capacity control, but also reduces the amount of flow required for effective surge control, which increases compressor efficiency.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A centrifugal compressor, comprising:

an impeller provided in a main flow path and configured to pressurize a main flow of fluid; and a secondary flow path configured to provide a secondary flow by recirculating a portion of the main flow, wherein less than or equal to 15% of the main flow becomes the secondary flow, wherein the secondary flow is introduced back into the main flow path by a plurality of injection nozzles each having a diameter within a range of 300 to 500 microns, and wherein the injection nozzles are circumferentially spaced-apart from one another by an arc length within a range of 8 to 25 of the diameters.

2. The compressor as recited in claim 1, wherein less than or equal to 10% of the main flow becomes the secondary flow.

3. The compressor as recited in claim 2, wherein 8.5% of the main flow becomes the secondary flow.

4. The compressor as recited in claim 1, including an injection plate, the injection nozzles formed in the injection plate.

5. The compressor as recited in claim 1, wherein the secondary flow path includes one of a volute and a plenum adjacent inlets of the injection nozzles.

6. The compressor as recited in claim 1, wherein the plurality of injection nozzles are configured to introduce the secondary flow into the main flow path in a direction normal to a direction of the flow of fluid in the main flow path.

7. The compressor as recited in claim 1, wherein the plurality of injection nozzles are radially aligned with one another relative to an axis of rotation of the impeller.

8. The compressor as recited in claim 7, wherein the plurality of injection nozzles are evenly spaced-apart from one another in a circumferential direction.

9. The compressor as recited in claim 8, wherein the plurality of injection nozzles have the same diameter.

10. The compressor as recited in claim 1, wherein the secondary flow is reintroduced back into the main flow path at a location downstream of the impeller.

11. The compressor as recited in claim 10, wherein the impeller is a first impeller within the main flow path, and wherein the compressor further includes a second impeller within the main flow path, the second impeller downstream of the first impeller.

12. The compressor as recited in claim 11, wherein the secondary flow enters the secondary flow path at a location downstream of the second impeller.

13. The compressor as recited in claim 1, further including:

a controller; and a flow regulator provided in the secondary flow path, the flow regulator selectively regulating the secondary flow within the secondary flow path in response to instructions from the controller.

14. A centrifugal compressor, comprising:

an impeller provided in a main flow path and configured to pressurize a main flow of fluid;

a secondary flow path configured to provide a secondary flow into the main flow; and injection nozzles configured to introduce the secondary flow back into the main flow path, the injection nozzles each having a diameter within a range of 300 to 500 microns, wherein the injection nozzles are radially aligned relative to an axis of rotation of the impeller and are also circumferentially spaced-apart from one another by an arc length within a range of 8 and 25 of the diameters.

15. The compressor as recited in claim 14, wherein less than or equal to 15% of the main flow is recirculated and becomes the secondary flow.

16. A method of operating a centrifugal compressor, comprising:

establishing a main flow of fluid along a main flow path;

pressurizing the main flow with an impeller; and selectively providing a secondary flow by recirculating less than or equal to 15% of the main flow, wherein the secondary flow is introduced back into the main flow path by a plurality of injection nozzles, the injection nozzles each having a diameter within a range of 300 to 500 microns, wherein the plurality of injection nozzles are circumferentially spaced-apart from one another by an arc length within a range of 5 and 8 millimeters.

* * * * *